US005551354A

United States Patent [19]

Crofut et al.

[11] Patent Number: 5,551,354

[45] Date of Patent: Sep. 3, 1996

[54] BIASED FLOW DIRECTIONAL LIQUOR NOZZLE

[75] Inventors: Stanton A. Crofut, Massillon; Edward E. Gayhart, Jr., North Canton, both of Ohio; John B. Parisi, Totowa, N.J.

[73] Assignee: The Babcock & Wilcox Company, New Orleans, La.

[21] Appl. No.: 518,436

[22] Filed: Aug. 23, 1995

[51] Int. Cl.[6] ..... F23G 7/04; B44D 1/08

[52] U.S. Cl. ..... 110/238; 239/518; 239/598

[58] Field of Search ..... 239/518, 521, 239/524, 598, 597; 110/238, 239

[56] References Cited

U.S. PATENT DOCUMENTS

| | | | |
|---|---|---|---|
| 1,335,267 | 3/1920 | Ambrose et al. | 239/598 |
| 2,619,388 | 11/1952 | Wahlin | 239/597 |
| 3,737,108 | 6/1973 | Stumphauzer et al. | 239/598 |
| 4,248,409 | 2/1981 | Langlitz et al. | 266/268 |
| 4,416,422 | 11/1983 | Tinnis | 239/455 |
| 4,523,747 | 6/1985 | Schnitzer et al. | 266/44 |
| 4,653,730 | 3/1987 | Wunsche et al. | 266/47 |
| 4,659,020 | 4/1987 | Kutrow | 239/752 |
| 4,750,649 | 6/1988 | Fahey et al. | 222/592 |
| 5,044,327 | 9/1991 | Hunt | 122/6.6 |

*Primary Examiner*—Noah P. Kamen

*Attorney, Agent, or Firm*—Daniel S. Kalka; Robert J. Edwards

[57] ABSTRACT

An apparatus for spraying liquor onto the walls of a recovery boiler furnace has a biased opening at the end of a nozzle. The bias and reduced opening size cause the liquor stream to be flattened and allow for direction of the stream onto specific walls of the furnace. A method for using the apparatus to direct the stream of liquor onto a particular furnace wall is also disclosed.

3 Claims, 4 Drawing Sheets

BIASED FLOW DIRECTIONAL LIQUOR NOZZLE

BACKGROUND OF THE INVENTION

1. Field of the Invention

The present invention relates, in general, to the field of recovery boiler auxiliary systems, the use of black liquor as a fuel, and in particular to a new and useful nozzle for directional flow of black liquor into a recovery furnace.

2. Description of the Related Art

The basic splash plate spray nozzle has been used in recovery boilers since 1929 and a patent granted thereon to G. H. Tomlinson and L. S. Wilcoxsin. A splash plate spray nozzle is used to deliver black liquor fuel to the furnace, where it is dried to particles called char (devolatized liquor consisting of carbon bound to inorganic chemicals) by the heat emitted from existing char burning below it. A typical delivery system, including a splash plate spray nozzle, is shown in *Steam,* 40th Ed. in FIG. 17 at page 26-15, shown as FIG. 4 herein. Air ports on the side walls of the furnace facilitate char combustion on the floor of the furnace.

Problems arise when the char bed piles in the center of the furnace, away from the air flow at the side wall ports, requiring an excessive secondary air source to control the size of the char bed by burning the material and this in turn causes excessive sodium fuming of liquor carryover to the convection passes, which leads to fouling of heat transfer surfaces.

The standard splash plate spray nozzle has no directional control of the flow of black liquor, and often large char beds are created on the furnace floor away from the side walls and the primary air ports, requiring additional secondary air to burn the material and control the char bed height. Also, within a standard splash plate spray nozzle in a large furnace, black liquor droplets must traverse greater distances to reach the far side walls than the adjacent side walls of the furnace; this results in excessive droplet combustion in flight, rather than the droplets reaching the furnace walls, where they then drop to the furnace floor near the air ports to be burned properly.

Another type of nozzle is disclosed in an application by Babcock & Wilcox, Ser. No. 08/347,761 filed Nov. 30, 1994, for a wedge splash nozzle.

SUMMARY OF THE INVENTION

An object of the present invention is to reduce the char bed piling in the center of the furnace, away from the primary air ports by effecting a perimeter distribution of the black liquor spray in the furnace.

The present invention allows the directing of the black liquor spray to adjacent side walls, in a perimeter distribution in two ways. First, the nozzle itself has notches which are asymmetrical, with one long and one short notch, created by extending the nozzle towards the splash plate. Secondly, the nozzle can be oriented through the use of elbows or bent piping so that the long notched side is parallel with the wall of entry.

The asymmetrical notches cause liquor flow to be heavier and flight distance of the liquor to be greater on the short-notched side. Since the liquor flowing out the short-notched side is in a heavier stream, it can reach the far end of the adjacent furnace wall before the liquor combusts in mid-flight or falls short of the walls.

A further object of the invention is to reduce the splatter of the black liquor on the splash plate, resulting in a flatter spray pattern emanating from the nozzle. This also aids in effecting the perimeter distribution which is desired.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
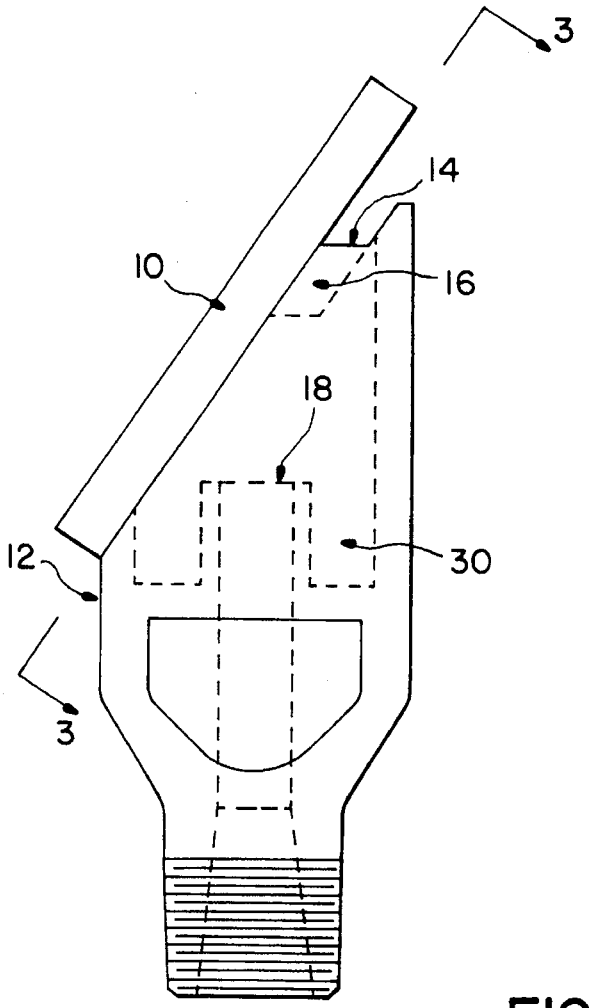
FIG. 1 is a side view of a nozzle with an extended hood opposite the splash plate according to the present invention.

Referring to the drawings in particular, the invention embodied in FIG. 1 comprises a housing 12 surrounding a conduit 18 for delivering a liquor from a main assembly, not shown. The housing has a counter bore groove 30 around the conduit 18. The housing 12 has a splash plate 10 attached to it at an acute angle to the longitudinal axis of the conduit 18. The end of the housing 12 is extended toward the splash plate leaving an asymmetrical gap resulting in a short directional notch 14 and long directional notch 16 parallel with the top surface of the splash plate 10.

Figure 2:
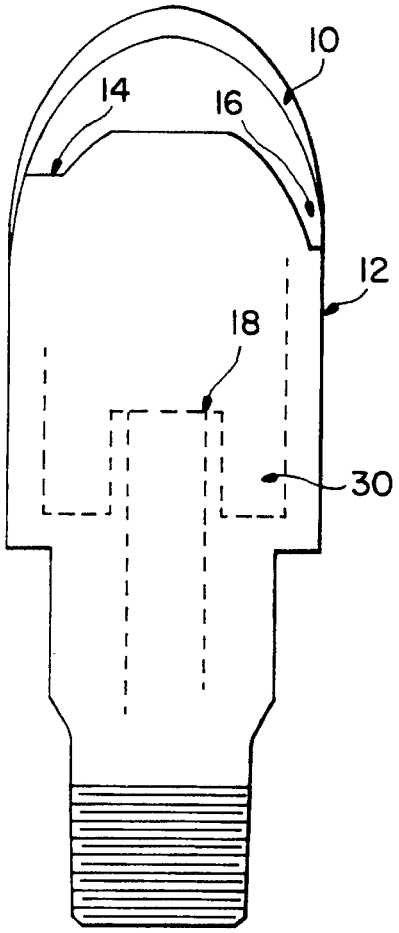
FIG. 2 is a front view of the nozzle with asymmetrical notches.

FIG. 2 substantially shows the short directional notch 14 and long directional notch 16 in relation to each other. Although notches 14 and 16 are shown on particular sides of the invention, their positions may be transposed and still be within the scope of the present invention.

Figure 3:
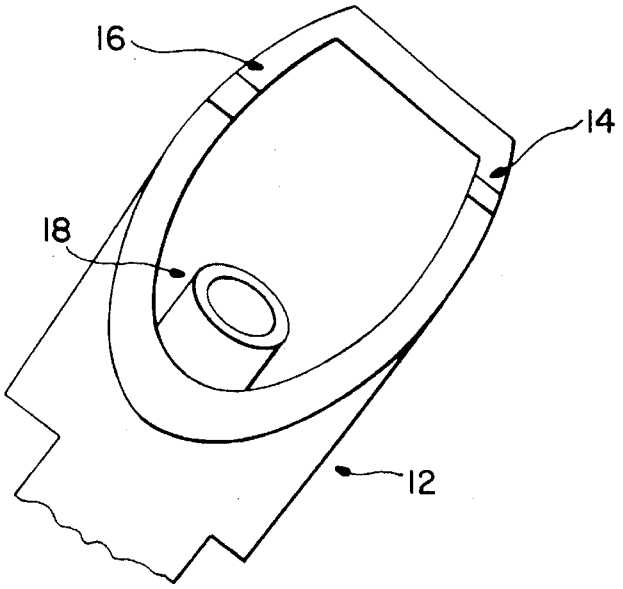
FIG. 3 is a sectional view along line 3—3 of FIG. 1 with the asymmetrical notches more clearly shown.

FIG. 3 substantially shows the directional notches 14 and 16 and the extension of the housing 12, which forms one side of the notches, in relation to the conduit 18.

Figure 4:
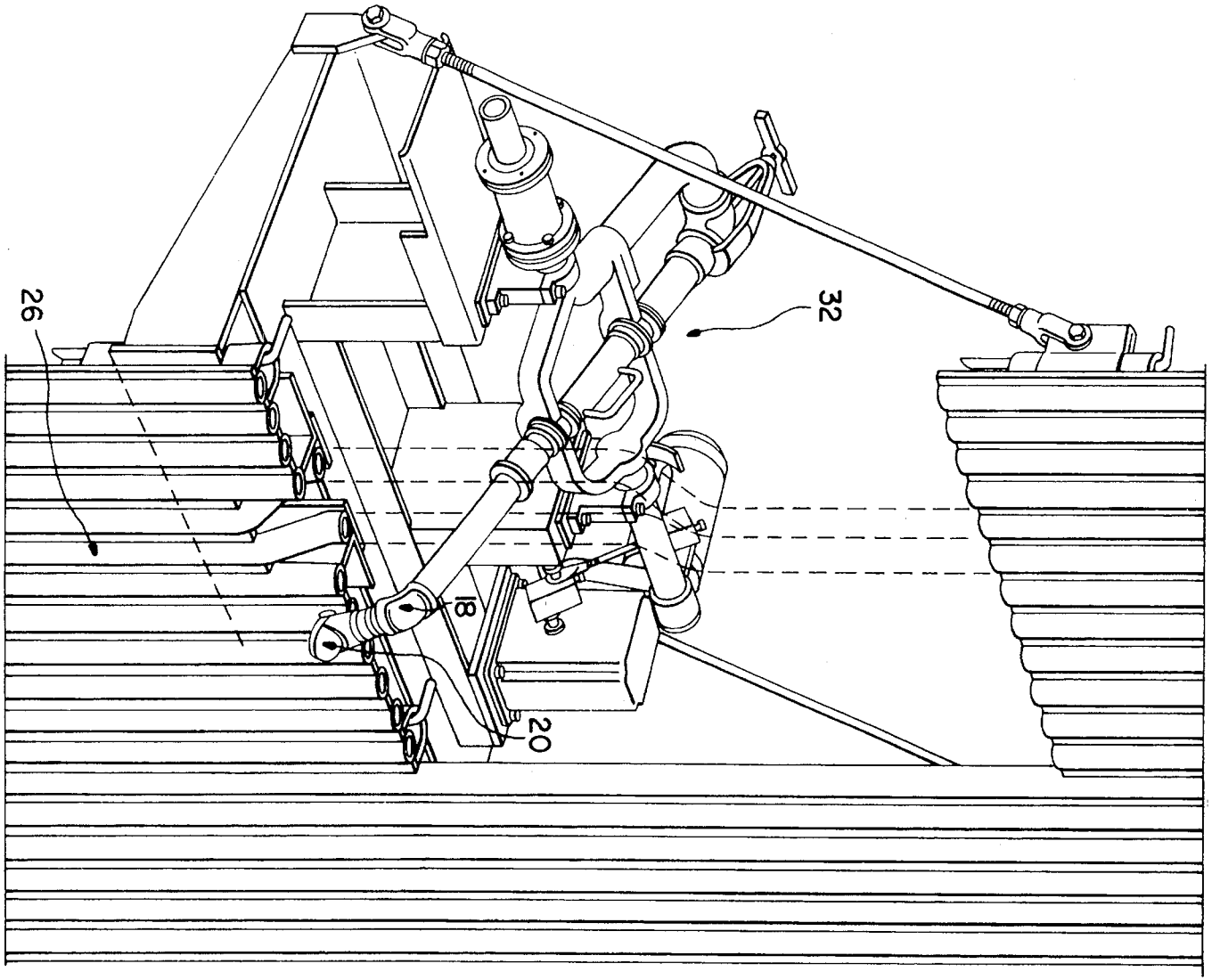
FIG. 4 is a perspective view of a limited vertical sweep burner assembly with a conventional splash plate spray nozzle attached.

FIG. 4 is illustrative of a use for the present invention, although this figure shows a standard splash plate spray nozzle 20 connected to a conduit 18 as part of a limited vertical sweep burner apparatus 32. The conduit 18 is shown protruding through a furnace wall of entry 34 in a use envisioned for the present invention also.

Figure 5:
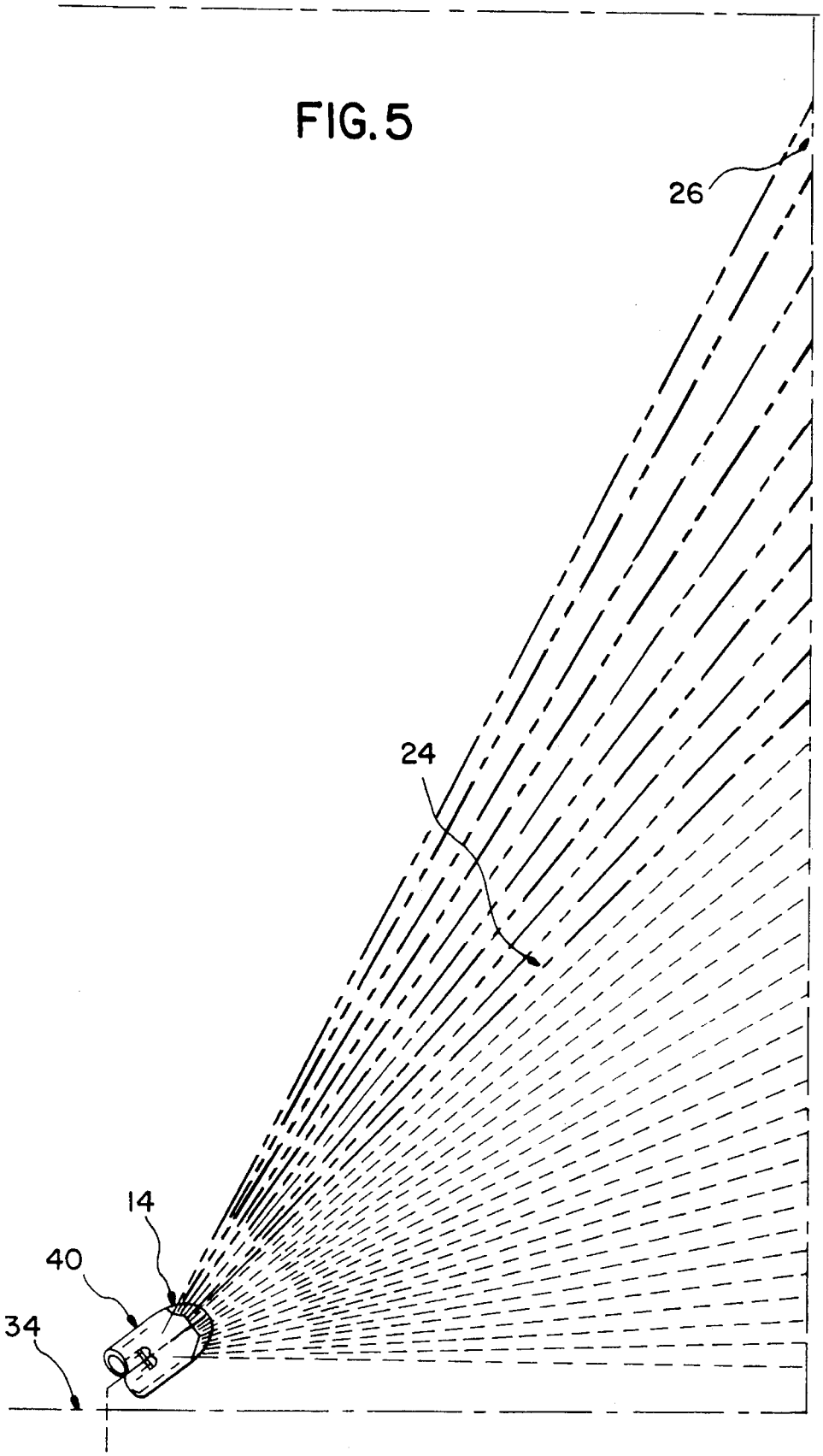
FIG. 5 is a view illustrating a distribution pattern of black liquor from the nozzle with the long-notched side parallel to the wall of entry.

The illustration in FIG. 5 is representative of spray 24 that results from use of the present invention nozzle assembly 40. The nozzle assembly 40 is shown oriented so that the long directional notch 16 is parallel to the wall of entry 34. Spray 24 emanates radially from the present invention 40 in a flattened stream and strikes furnace wall 26.

Figure 6:
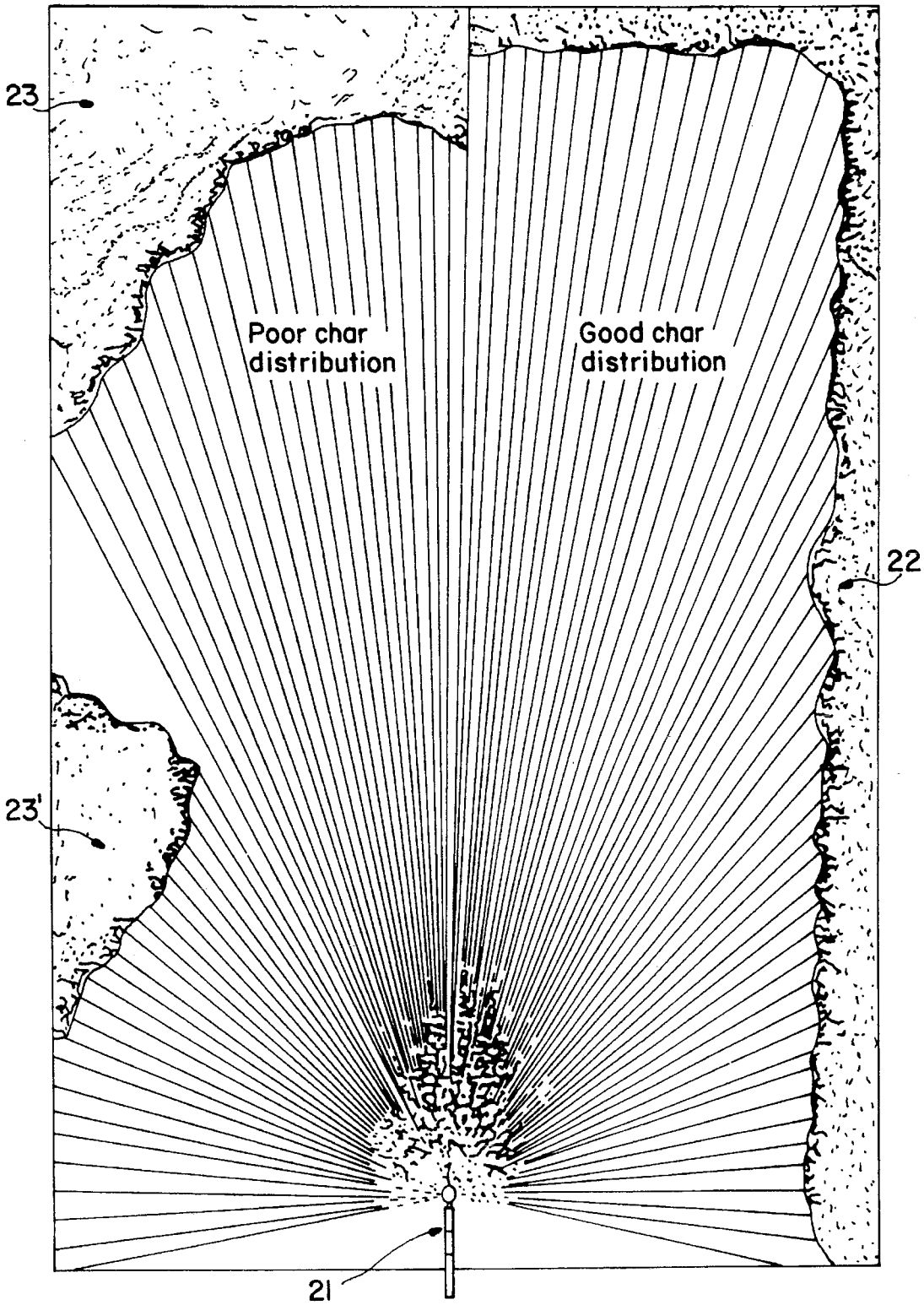
FIG. 6 is a view of typical char band distributions, the left half being a poor distribution pattern and the right half being the desired distribution pattern.

In FIG. 6, two different distribution patterns are illustrated side by side. In both cases, the spray originates at spray nozzle 21, which represents the desired spray pattern for the right half of the illustration and a poor distribution pattern on the left half of the illustration. Char band 22, on the right of the illustration substantially shows the effect of using the present invention in a recovery furnace. Char band 22 is spread evenly about the walls 26 as desired. Char beds 23 and 23', on the left of the illustration, are representative of the results of undesirable spray distributions.

While a specific embodiment of the invention has been shown and described in detail to illustrate the application of the principles of the invention, it will be understood that the invention may be embodied otherwise without departing from such principles.

What is claimed is:

1. A biased flow directional black liquor nozzle for spraying a black liquor in a recovery furnace, the nozzle comprising:

a conduit with an open end for carrying a black liquor, the conduit having a longitudinal axis;

a housing connected to the open end of the conduit, the housing defining a chamber forming enclosure with an outlet, the outlet having a short-notched side on one side of the axis and a long-notched side on an opposite side of the axis; and a splash plate attached to said chamber forming enclosure at an acute angle to the longitudinal axis of the conduit and covering said notches to define said short and long-notched sides of said outlet for spraying the black liquor asymmetrically with respect to the axis for spreading a char band evenly on a furnace wall of a recovery boiler.

2. A nozzle according to claim 1, wherein said long-notched side is oriented parallel to a furnace wall of entry.

3. A nozzle according to claim 1, wherein the housing includes a counter bore groove around the conduit.

* * * * *